US006364454B1

(12) United States Patent
Hadimioglu

(10) Patent No.: US 6,364,454 B1
(45) Date of Patent: Apr. 2, 2002

(54) ACOUSTIC INK PRINTING METHOD AND SYSTEM FOR IMPROVING UNIFORMITY BY MANIPULATING NONLINEAR CHARACTERISTICS IN THE SYSTEM

(75) Inventor: Babur B. Hadimioglu, Mountain View, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/163,524

(22) Filed: Sep. 30, 1998

(51) Int. Cl.[7] ..... B41J 2/135
(52) U.S. Cl. ..... 347/46
(58) Field of Search ..... 347/15, 46, 10; 358/298; 427/457, 565; 239/4, 102.2

(56) References Cited

U.S. PATENT DOCUMENTS

| | | | |
|---|---|---|---|
| 4,697,195 | A | 9/1987 | Quate et al. |
| 4,719,476 | A | 1/1988 | Elrod et al. |
| 4,719,480 | A | 1/1988 | Elrod et al. |
| 4,745,419 | A | 5/1988 | Quate et al. |
| 4,748,453 | A | 5/1988 | Lin et al. |
| 4,748,461 | A | 5/1988 | Elrod |

(List continued on next page.)

FOREIGN PATENT DOCUMENTS

| | | |
|---|---|---|
| EP | 0 572 241 | 12/1993 |
| EP | 0 739 732 | 5/1997 |

OTHER PUBLICATIONS

D. Rugar, Resolution Beyond the Diffraction Limit in the Acoustic Microscope: A Nonlinear Effect, 56 Journal of Applied Physics (5), pp. 1338–1346 (1984).

*Primary Examiner*—John Barlow
*Assistant Examiner*—Michael S. Brooke
(74) *Attorney, Agent, or Firm*—Fay, Sharpe, Fagan, Minnich & McKee, LLP

(57) ABSTRACT

An acoustic ink method and system are provided for improving the uniformity in an acoustic ink printing system by manipulating nonlinear characteristics of the system. The method includes operating the system at a power level that is above the power level at which the nonlinearity of the system is initiated.

12 Claims, 6 Drawing Sheets

U.S. PATENT DOCUMENTS 4,751,529 A 6/1988 Elrod et al.
4,751,530 A 6/1988 Elrod et al.
4,751,534 A 6/1988 Elrod et al.
4,774,529 A 9/1988 Paranjipe et al.
4,782,350 A 11/1988 Smith et al.
4,797,693 A 1/1989 Quate
4,801,953 A 1/1989 Quate
4,908,638 A 3/1990 Albosta et al.
4,959,674 A 9/1990 Khri-Yakub et al.
5,028,937 A 7/1991 Khuri-Yakub et al.
5,038,184 A 8/1991 Chiang et al.
5,041,849 A 8/1991 Quate et al.
5,087,931 A 2/1992 Rawson
5,111,220 A 5/1992 Hadimioglu et al.
5,121,141 A 6/1992 Hadimoglu et al.
5,122,818 A 6/1992 Elrod et al.
5,142,307 A 8/1992 Elrod et al.
5,191,354 A 3/1993 Quate
5,194,880 A 3/1993 Elrod et al.
5,216,451 A 6/1993 Rawson et al.
5,229,793 A 7/1993 Hadimioglu et al.
5,231,426 A 7/1993 Sweet
5,268,610 A 12/1993 Hadimioglu et al.
5,277,754 A 1/1994 Hadimioglu et al.
5,278,028 A 1/1994 Hadimioglu et al.
5,287,126 A 2/1994 Quate
5,305,016 A 4/1994 Quate
5,339,101 A 8/1994 Rawson et al.
5,354,419 A 10/1994 Hadimioglu
5,389,956 A 2/1995 Hadimioglu et al.
5,392,064 A 2/1995 Hadimioglu et al.
5,416,596 A * 5/1995 Suzuki et al. ..... 358/298
5,428,381 A 6/1995 Hadimioglu et al.
5,450,107 A 9/1995 Rawson
5,453,767 A * 9/1995 Chang et al. ..... 347/10
5,541,627 A 7/1996 Quate
5,565,113 A 10/1996 Hadimioglu et al.
5,589,864 A 12/1996 Hadimioglu
5,591,490 A 1/1997 Quate
5,608,433 A 3/1997 Quate
5,629,724 A 5/1997 Elrod et al.
5,631,678 A 5/1997 Hadimioglu et al.
5,686,945 A 11/1997 Quate et al.
5,808,636 A 9/1998 Stearns

* cited by examiner

ACOUSTIC INK PRINTING METHOD AND SYSTEM FOR IMPROVING UNIFORMITY BY MANIPULATING NONLINEAR CHARACTERISTICS IN THE SYSTEM

BACKGROUND OF THE INVENTION

This invention relates to an acoustic ink printing method and system for improving uniformity by manipulating nonlinearity characteristics in the system. More particularly, the invention is directed to manipulation of the acoustic power output of the system relative to a power level at which nonlinearity of the system is onset. This is accomplished in the invention by a variety of techniques, including reducing the onset power level (of nonlinearity) and/or increasing the operating or output, power level such that the operating power level is greater than the onset power level.

While the invention is particularly directed to the art of acoustic ink printing, and will thus be described with specific reference thereto, it will be appreciated that the invention may have usefulness in other fields and applications.

By way of background, acoustic ink printing involves the emitting of a droplet of ink from a pool of ink toward a print medium. Sound waves are generated and focussed toward the surface of the ink pool to emit the droplet therefrom. While acoustic ink printing elements may take various forms, such elements typically include a piezoelectric transducer, a lens, a cover plate having apertures formed therein to allow emission of the ink, and corresponding wiring. It is to be appreciated that approximately one thousand (1,000) or more of these elements may be disposed on a single printhead.

A difficulty with acoustic ink printing elements is that they are susceptible to a variety of factors that result in non-uniformity in the system. Such non-uniformity is undesirable because it causes non-uniformity in the emitted droplets, and thus reduces the precision, accuracy, and quality of the printing accomplished by the system.

Sources of non-uniformity in the system are many. For example, the cover plate may not be completely flat, causing the ink surface from which droplets are emitted to vary from ejector to ejector. Another source of non-uniformity is in the structure of the lens. This impacts on the efficiency of focussing the waves which cause the emission of the droplet from the surface of the ink.

Other sources of non-uniformity relate to the piezoelectric element. For example, nonuniform thickness of the piezoelectric element may influence the uniformity of operation across the printhead. In addition, certain inherent characteristics of the piezoelectric element, such as the electromechanical coupling constant—which determines the coupling between the electrical signal and the sound wave—may vary across the element and, thus, adversely impact uniformity of operation.

Still yet another source of non-uniformity in the system resides in the wiring patterns that are typically printed on the printhead. It should be appreciated that the resistance and reactance of these patterns cause non-uniformity to exist because the distances from the power source to different elements vary.

The present invention contemplates a new and improved acoustic ink printing method and system which resolve the above-referenced difficulties and others by manipulating the nonlinear characteristics of the system to compensate for the non-uniformities that may be present therein.

SUMMARY OF THE INVENTION

An acoustic ink method and system are provided for improving the uniformity in an acoustic ink printing system by manipulating nonlinear characteristics of the system. The invention includes operating the system at a power level that is above the power level at which the nonlinearity of the system is initiated in a variety of manners.

In one aspect of the invention, the density of the ink is reduced.

In another aspect of the invention, the nonlinearity constant of the ink is increased.

In another aspect of the invention, the F number of the lens is increased.

In another aspect of the invention, the frequency of the sound waves is increased.

In another aspect of the invention, the sound velocity of the sound waves through the ink is decreased.

In another aspect of the invention, the pulse width of the input RF pulse is reduced to increase peak operating power.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention exists in the construction, arrangement, and combination, of various parts of the device and steps of the method, whereby the objects contemplated are obtained as hereinafter more fully set forth, specifically pointed out in the claims, and illustrated in the accompanying drawings in which:

DETAILED DESCRIPTION OF THE PREFERRED EMBODIMENTS

Figure 1:
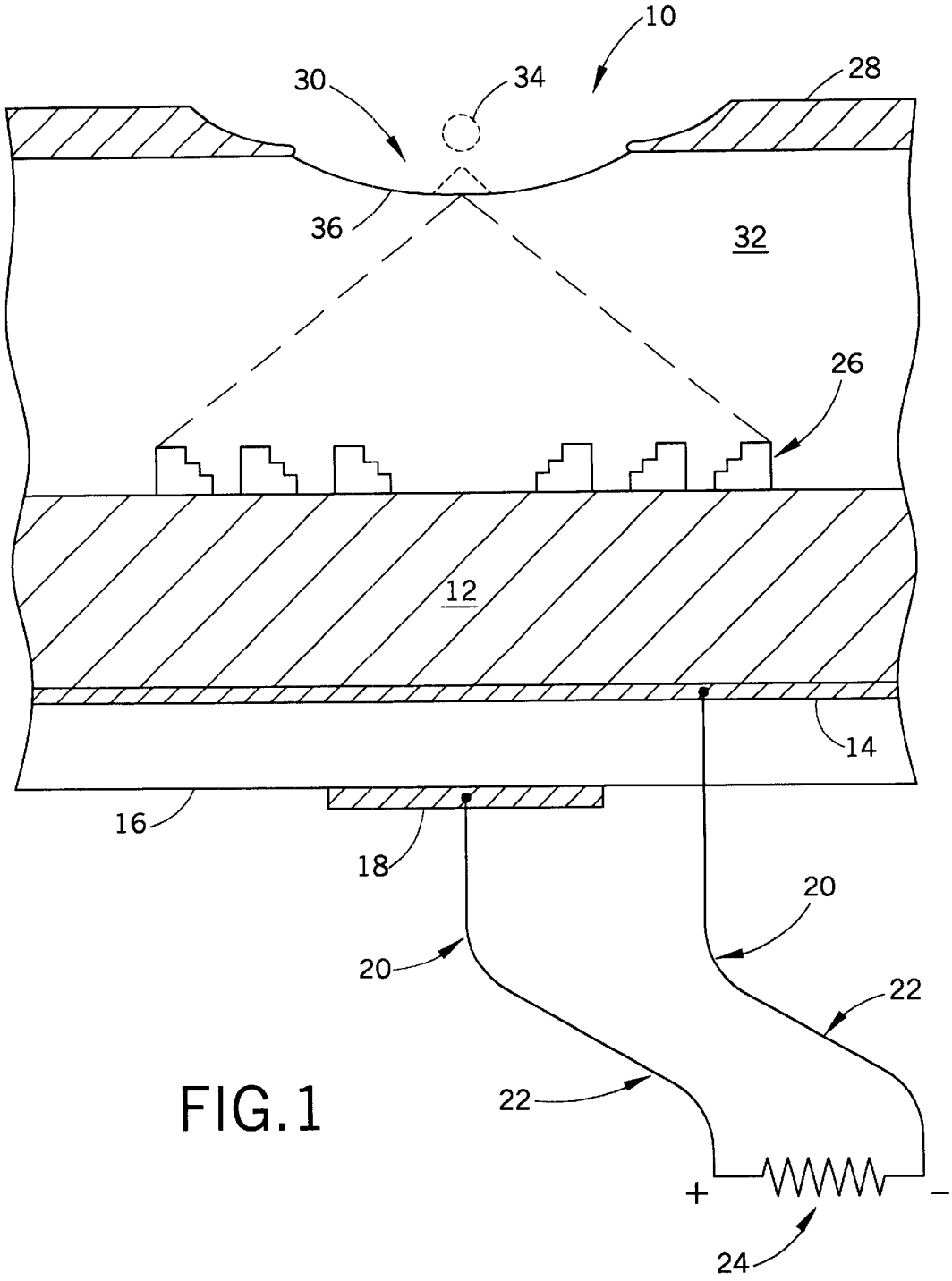
FIG. 1 is a representative illustration of an acoustic ink printing element to which the present invention may be applied.

Referring now to the figures wherein the drawings are for the purposes of illustrating the preferred embodiments of the invention only, and not for purposes of limiting same, FIG. 1 provides a view of an exemplary acoustic ink printing element 10 to which the present invention may be applied. Of course, other configurations may also have the present invention applied thereto.

As shown, the element 10 includes a glass layer 12 having an electrode layer 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown at 20 and cables 22 to a radio frequency (RF) power source 24 which generates power that is transferred to the electrodes 14 and 18. On a side opposite the electrode layer 14, a lens 26, preferably a concentric Fresnel lens, is formed. Spaced from the lens 26 is a liquid level control plate 28, having an aperture 30 formed therein. Ink 32 is retained between the liquid level control plate 28 and the glass layer 12, and the aperture 30 is aligned with the lens 26 to facilitate emission of a droplet 34 from ink surface 36. Ink surface 36 is, of course, exposed by the aperture 30.

The lens 26, the electrode layer 14, the piezoelectric layer 16, and the electrode 18 are formed on the glass layer 12 through known photolithographic techniques. The liquid level control plate 28 is subsequently positioned to be spaced from the glass layer 12. The ink 32 is fed into the space between the plate 28 and the glass layer 12 from an ink supply (not shown).

Figure 2:
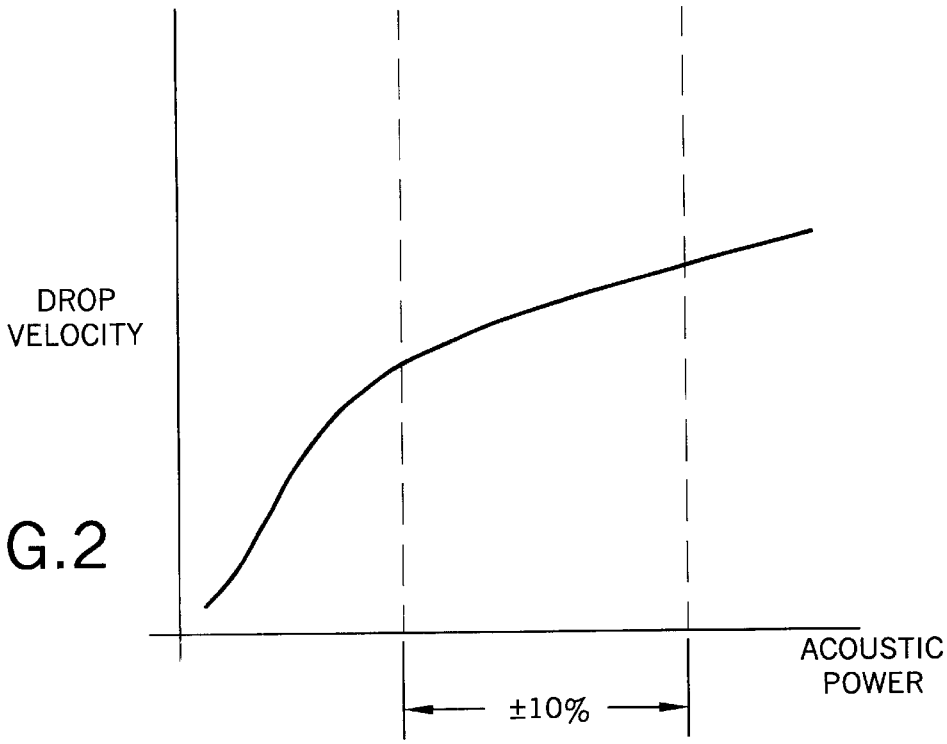
FIG. 2 is a graph representing the preferred operating region of an acoustic ink printing element in terms of drop velocity versus acoustic power.

The acoustic ink printing ink element 10 shown in FIG. 1 has a preferred operating region of acoustic output power as a function of ink drop velocity. As shown in FIG. 2—which is a graph of drop velocity versus acoustic output power (or amplitude of sound waves) at the liquid surface—the preferred operating region is defined to be within ±10% of a known sound wave amplitude. For amplitudes less than any value in the region, no droplet will be emitted from the printhead or the ejected drop velocity might be too low, causing print quality issues (due to drop misplacement). For amplitudes greater than all values in the preferred operating region, satellite droplets will likely be emitted in addition to the desired drop emitted. Satellite droplets cause undesirable blurring and other artifacts in the printed character or image. Therefore, it is desirable to operate the acoustic printing element 10 within this preferred region.

The acoustic ink printing element 10, however, experiences the nonuniformity difficulties noted above in the Background of the Invention. This nonuniformity contributes to the operation of the element outside the preferred region of FIG. 2. Accordingly, a goal of the present invention is to improve the uniformity of the acoustic power at the ink surface while also avoiding unnecessarily high tolerances in the fabrication process. Strict tolerances to maintain the element within the preferred region could result in unnecessarily high fabrication cost and overly complicated processes.

Figure 3:
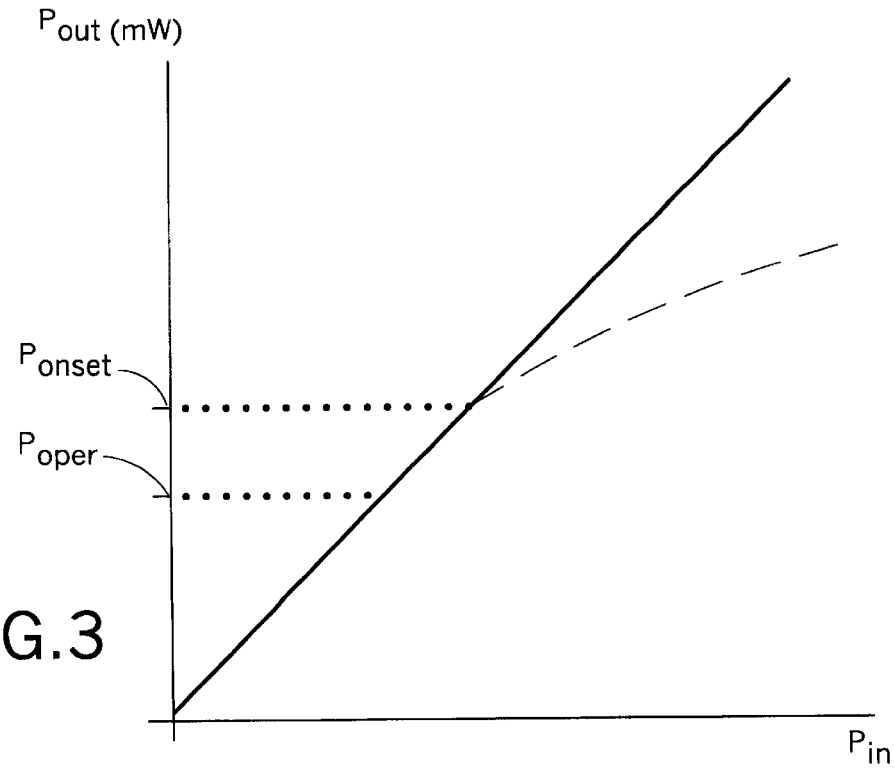
FIG. 3 is a graph showing the power-in/power-out relationship of a system using elements shown in FIG. 1.

Therefore, to improve uniformity in the element 10 shown in FIG. 1, the nonlinearity of the system is manipulated. More particularly, referring now to FIG. 3, an input acoustic power ($P_{in}$) to output acoustic power ($P_{out}$) relationship is shown. The various lines of both FIGS. 3 and 4 (*a*) and (*b*) represent different possible responses for a system such as that described above. For example, in FIG. 3, the solid line represents a system that operates in a linear fashion. In a linear system, changes in input power correlate directly to changes in output. The dashed line represents a typical acoustic ink printhead response (e.g. a printhead comprising elements 10 of FIG. 2) whereby the system operates in a region of low nonlinearity. Thus, a large change in output power results when input power is varied. Moreover, depending on the liquid being emitted, the operating power ($P_{oper}$) is typically in a range of 5–10 mW while the onset power ($P_{onset}$)—the power level at which nonlinearity of the system response occurs—is also in the range of 5–10 mW but oftentimes is greater than the operating power as shown in FIG. 3.

Figure 4A:
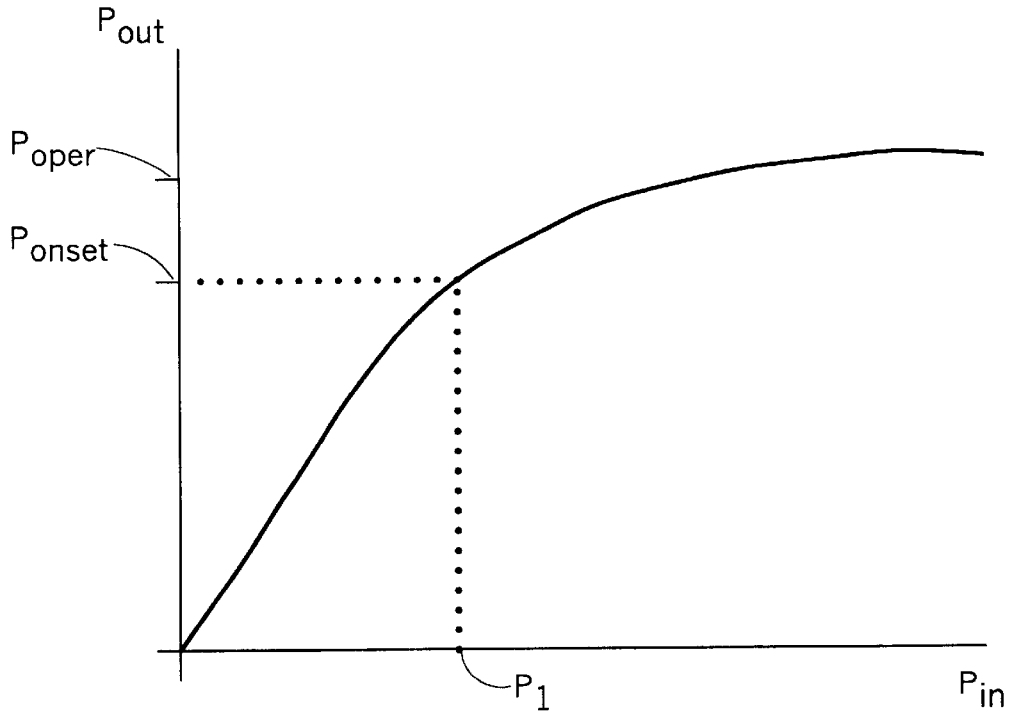
FIGS. 4(*a*) and (*b*) are graphs showing the desired power-in/power-out relationship and ideal power-in/power-out relationship, respectively, of a system according to the present invention.
Figure 4B:
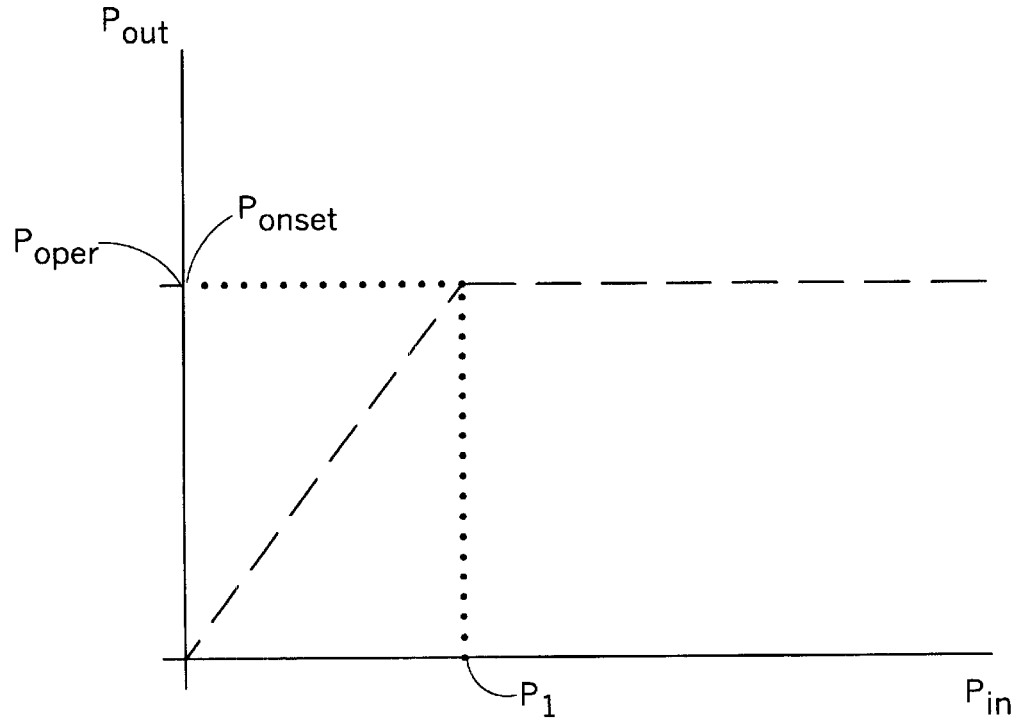

Referring now to FIG. 4(*a*), a desired response for a system according to the present invention is shown by the solid line. This response shows high nonlinearity in that only a small change in output power ($P_{out}$) occurs when input power ($P_{in}$) is varied assuming the input power exceeds a certain level ($P_1$). In this regard, it should be appreciated that the desired response requires that the operating power of the system be greater than the onset power.

Of course, referring to FIG. 4(*b*), the ideal response for the system according to the present invention is shown by the dashed line. The graph indicates that, in this case, the operating power roper is equal to the onset power $P_{onset}$. An ideal system would result in no output power ($P_{out}$) change when input power is varied, assuming the input power ($P_{in}$) exceeds a certain level (e.g. ($P_1$)).

Therefore, the present invention is directed to maintaining the operation region of the device in the nonlinear portion of the graph shown in FIG. 4(*a*) to allow greater latitude on the power input to the system and less deviation at the output. This will compensate for nonuniformities present in the system at the input side, e.g. wiring pattern, transducer, glass, and lens, to achieve a uniform output acoustic power at the surface of the ink and allow the system to operate in the preferred operating region shown in FIG. 2.

According to the present invention, a variety of ways to achieve the preferred nonlinearity in the system exists. One way is to design a transducer switching element such that the RF current to the transducer is more or less constant, independent from the RF voltage. Although this type of nonlinearity reduces the nonuniformity due to resistance and reactance of RF distribution lines, it does not take care of the nonuniformities due to the transducers and lenses.

A preferred approach is to address nonuniformity in the lenses, glass, transducers, and wiring by operating the system in the nonlinear region by manipulating the nonlinear characteristics of sound wave propagation in the ink for focused, high amplitude sound waves. In this regard, the propagation of focused sound waves and liquids tends to be nonlinear when the peak acoustic power at the focus of the waves at the surface of the ink exceeds an onset power defined by the onset of nonlinearity in the system as follows (See, e.g., D. Rugar, 56 J. Appl. Phys. 1338 (1984)):

$$P_{onset} = \frac{0.1}{F^2 f^2} \rho \frac{c^5}{16\pi^3 \beta^2} \tag{1}$$

where ρ and c and β are the density, sound velocity and nonlinearity constant of the liquid, respectively, F is the ratio of a focal length of a lens to an aperture diameter and f is the frequency of sound waves.

Accordingly, as noted above, for typical operating conditions of the acoustic ink printer with aqueous type inks, $P_{onset}$ is about 5–10 mW whereas the nominal operating power of the printer is also in the range of 5–10 mW with a pulse width of approximately 2 μs; however, as noted above, the onset power is often times greater than the operating power (as shown in FIG. 3). So, the operating conditions of the printer are already close to the threshold of the nonlinear response. The present invention is directed to placing the operating level above the level of the onset of nonlinearity.

In a first embodiment of the invention, the acoustic ink printing element of FIG. 1, having a desired power-in ($P_{in}$)/power-out ($P_{out}$) relationship shown in FIG. 4(*a*), includes ink, disposed between the plate and the glass substrate, of a density that facilitates generation of output power at the surface of the ink at an operating power level that is above the onset power level. Referring to equation (1), this requires that the density of the ink be reduced so that the onset power is reduced. This assumes, of course, that all other variables are held constant.

In a second embodiment of the invention, an acoustic ink printing element of FIG. 1, having a desired power-in ($P_{in}$)/power-out ($P_{out}$) relationship shown in FIG. 4(*a*), includes ink, disposed between the plate and the glass substrate, having a nonlinearity constant to facilitate the generation of output power at a level that is above the onset power. This would be accomplished, referring to equation (1), by increasing the nonlinearity constant of ink so that the onset power is reduced. This assumes, of course, that all other variables are held constant.

In a third embodiment of the invention, an acoustic ink printing element of FIG. 1, having a desired power-in ($P_{in}$)/power-out ($P_{out}$) relationship of FIG. 4(*a*), includes a lens 26 having a focal length and an aperture 30 having a diameter. The ratio of the focal length to the aperture diameter of the cover plate is such that the generation of the output power is above the onset power. Referring to equation (1), the ratio of the focal length to the aperture diameter is defined as F. Accordingly, increasing F reduces the onset power. This assumes, of course, that all other variables are held constant.

In a fourth embodiment of the invention, an acoustic ink printing element of FIG. 1, having a desired power-in ($P_{in}$)/power-out ($P_{out}$) relationship of FIG. 4(*a*), is operated to propagate sound waves through the glass substrate at a frequency that will generate the output power at a level that is above the onset power. This would be accomplished, referring to equation (1), by increasing the frequency of the sound waves so that the onset power is reduced. This assumes, of course, that all other variables are held constant.

Figure 5:
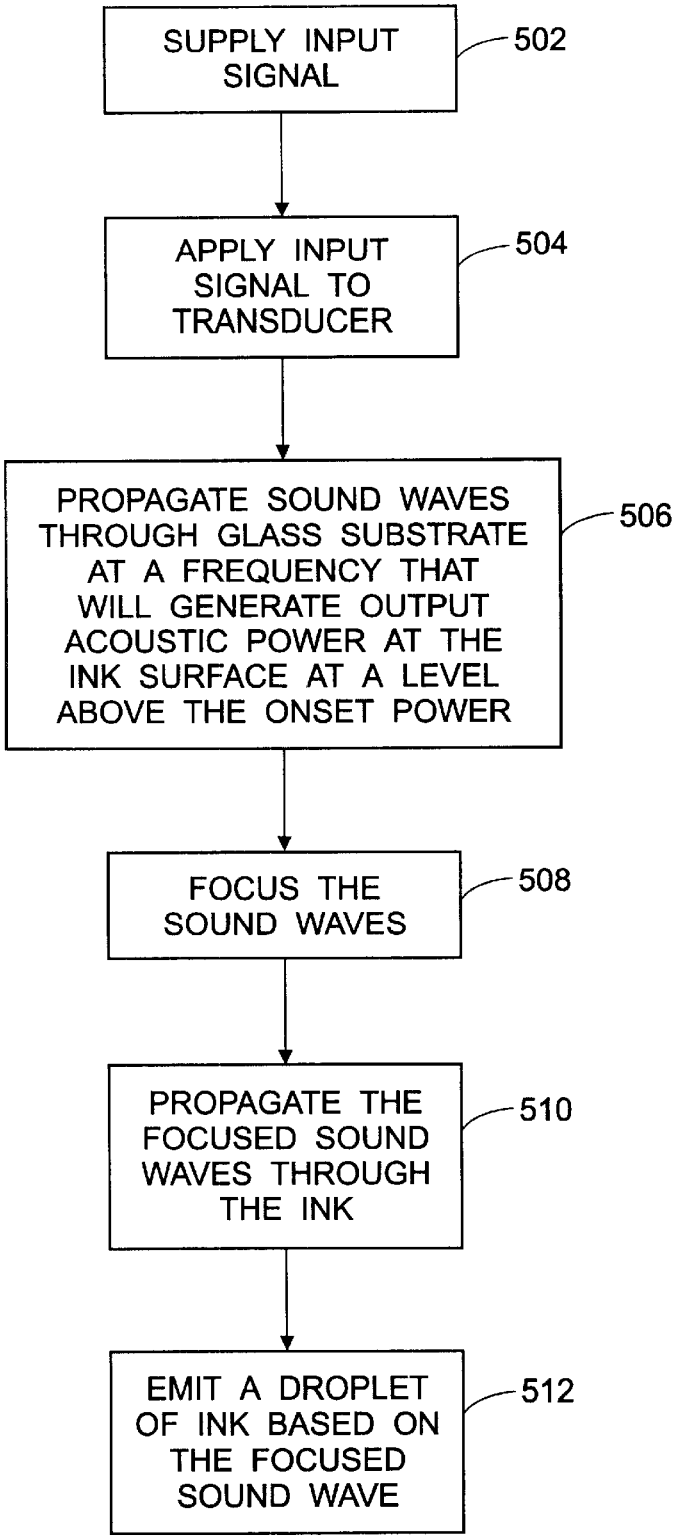
FIG. 5 is a flow chart showing a method according to the present invention.

As to the method of operation, referring now to FIG. 5, input power is supplied by generating a radio frequency signal (step 502). The generated signal is then applied to the piezoelectric transducer (step 504) which generates sound waves that are propagated through the glass substrate with a frequency that will generate output acoustic power at the ink surface at a level that is above the onset power (step 506). The generated sound waves are then focussed by the lens (step 508) and propagated through the ink (step 510 ). A droplet of ink is then emitted from the ink surface based on the focussed sound waves (step 512).

According to a fifth embodiment of the present invention, an acoustic ink printing element shown in FIG. 1, having a desired power-in ($P_{in}$)/power-out ($P_{out}$) relationship of FIG. 4(*a*), is operated to maintain the velocity of the sound waves in the ink such that the generated output power will be above the onset power. Referring to equation (1), this is accomplished by decreasing the sound velocity of the ink to reduce the onset power. This assumes, of course, that all other variables are held constant.

Figure 6:
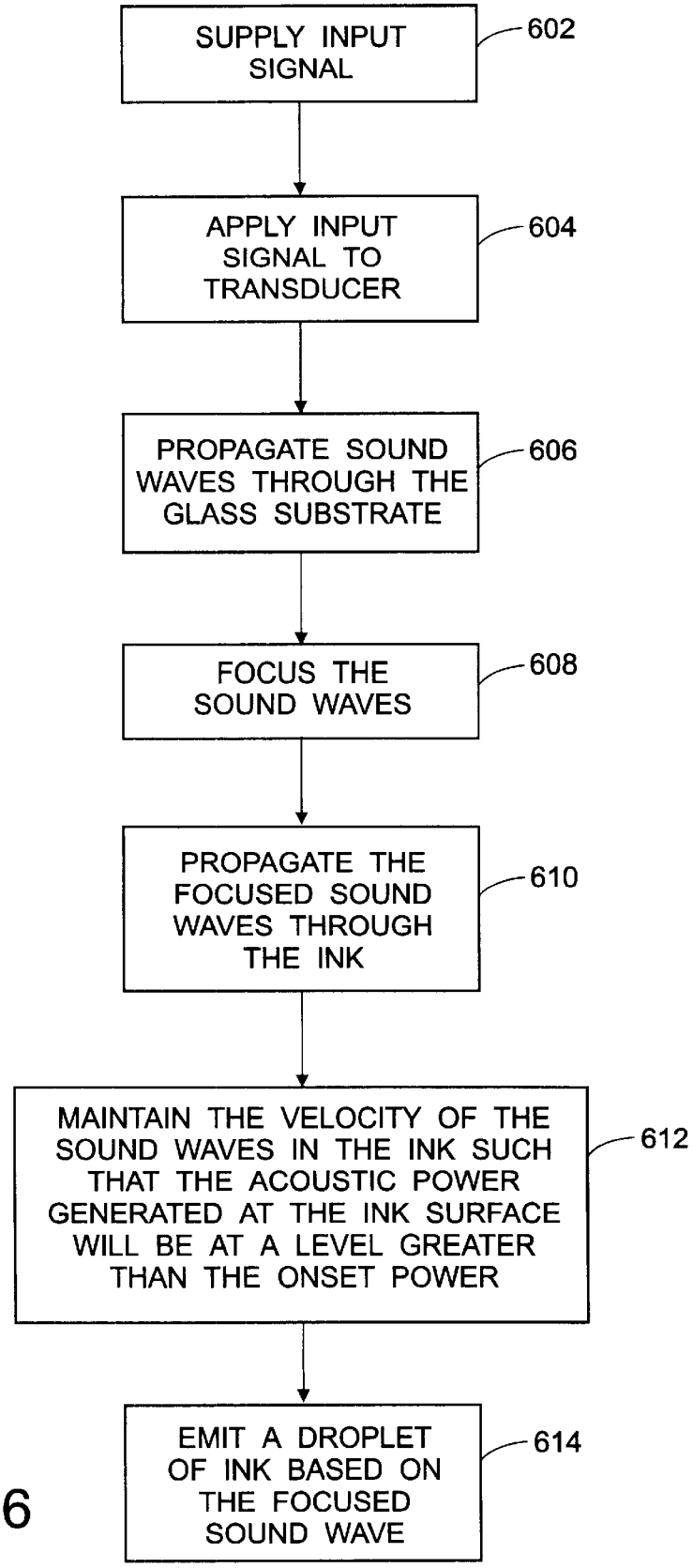
FIG. 6 is a flow chart showing a method according to the present invention; and, FIG. 7 is a flow chart showing a method according to the present invention.
Figure 7:
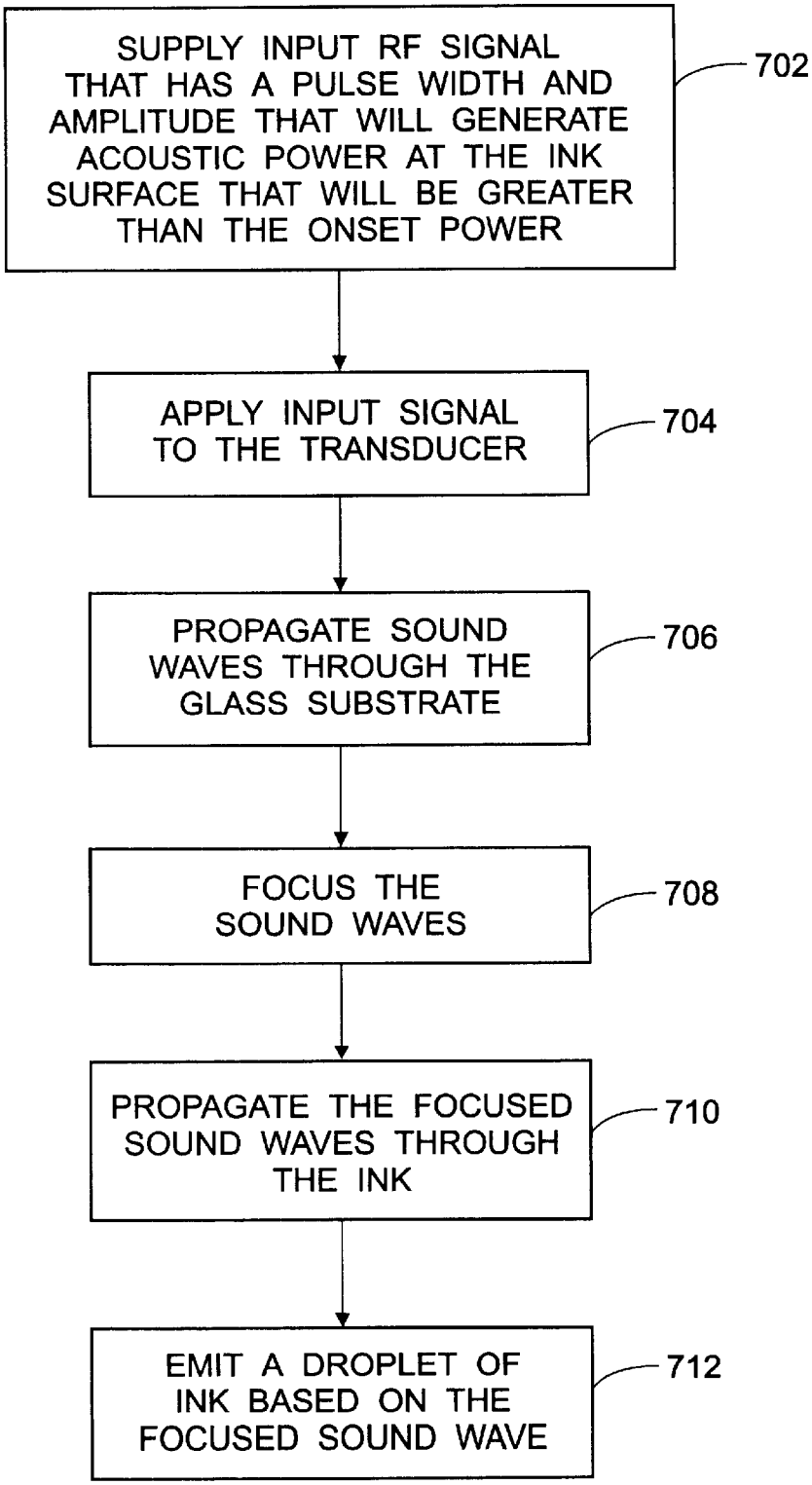

FIG. 6 shows a method according to the fifth embodiment of the present invention. As shown, input power is supplied by generating a radio frequency signal (step 602). The generated signal is then applied to the piezoelectric transducer (step 604) which propagates the sound waves through the glass substrate (step 606). Sound waves are then focussed by the lens (step 608) and propagated through the ink (step 610 ). The velocity of the focussed sound waves is maintained such that the generated output power will be at a level that is above the onset power (step 612). The droplet of ink is then emitted based on the focussed sound waves (step 614).

The aforenoted embodiments are directed to generating an output acoustic power at the ink surface at a level that is above the onset power level. This is accomplished in these embodiments by reducing the onset power level of the system. That is, these embodiments are directed to manipulating the nonlinearity characteristics of sound wave propagation through ink by manipulating the variables that are a function of the point at which nonlinearity of the system is onset. In doing so, the power onset level is reduced.

However, the operating power of the system could also be increased. As such, in a sixth embodiment of the present invention, an acoustic ink printing element of FIG. 1, having a power-in ($P_{in}$)/power-out ($P_{out}$) relationship of FIG. 4(*a*), is operated by generating a radio frequency signal that has a pulse width such that the generated output power will be above the onset power. Since the droplet ejection is influenced by the energy in the RF pulse, shorter RF pulses will have larger peak power levels. In this regard, for an RF pulse $$\text{Energy}=\text{Peak Power}\times\text{Pulse Width} \tag{2}$$

so the same energy may be realized by increasing the peak power (or amplitude) of the RF signal and decreasing the pulse width in equal proportions. Therefore, the nominal operation level may be increased above the onset to achieve the operation in the nonlinear region.

It should be noted that at very short pulse widths, the droplets become less stable due to some other nonlinear factors. Hence, in nonlinear operation under an unnecessarily short pulse width, the droplets become less stable due to some other nonlinear factors. Hence, nonlinear operation under an extremely short pulse condition may not be possible.

As to the method according to the sixth embodiment of the present invention, input power is supplied to the piezoelectric element by generating a radio frequency signal that has a pulse width such that generated output power at the ink surface will be at a level that is above the onset power level (step 702). The generated signal is then applied to the piezoelectric transducer (step 704) which generates sound waves which are propagated through the glass substrate (step 706). The sound waves are then focussed by the lens (step 708) and propagated through the ink (step 710 ). Last, a droplet of ink is emitted from the ink surface through the aperture based on the focus sound waves (step 712).

It is to be appreciated that the six different embodiments of the present invention are not mutually exclusive. That is, one, all six, or any combination thereof, may be used in order to achieve the desired results of the present invention. In this case, it is to be appreciated that different variables will be manipulated and others held constant. The choice as to which structural requirement or method of operation is used is dependent on the desire and need of the designer or user.

The above description merely provides a disclosure of particular embodiments of the invention and is not intended for the purposes of limiting the same thereto. As such, the invention is not limited to only the above described embodiments. Rather, it is recognized that one skilled in the art could conceive alternative embodiments which fall within the scope of the invention.

Having thus described the invention, I claim:

1. An acoustic ink printing element comprising:

means for supplying input acoustic power to the element; and, means for generating an output acoustic power that is above a power level corresponding to onset of nonlinearity as follows:

$$P_{onset} = \frac{0.1}{F^2 f^2} \rho \frac{c^5}{16\pi^3 \beta^2}$$

where ρ and c and β are density, sound velocity and nonlinearity constant of a liquid, respectively, F is a ratio of a focal length of a lens to an aperture diameter and f is frequency of sound waves.

2. The acoustic ink printing element as set forth in claim 1 wherein the generating means comprises the lens having the focal length and an aperture having the aperture diameter such that a ratio of the focal length to the aperture diameter is such that generation of the output acoustic power is at an operating level that is above the power level.

3. An acoustic ink printing element having a power transfer function that includes a nonlinear region, the nonlinear region being onset at a first power level, the element comprising:

a piezoelectric transducer;

a glass substrate attached to the piezoelectric transducer;

a lens formed on the glass substrate on a side opposite the piezoelectric transducer;

a liquid level control plate having an aperture formed therein and spaced from the substrate; and, ink disposed between the plate and the glass substrate having an ink surface exposed by the aperture, the ink having a density that facilitates the generation of an output acoustic power at the ink surface at a second power level that is above the first power level.

4. An acoustic ink printing element having a power transfer function that includes a nonlinear region, the nonlinear region being onset at a first power level, the element comprising:

a piezoelectric transducer;

a glass substrate attached to the piezoelectric transducer;

a lens formed on the glass substrate on a side opposite the piezoelectric transducer;

a liquid level control plate having an aperture formed therein and spaced from the substrate; and, ink disposed between the plate and the glass substrate having an ink surface exposed by the aperture, the ink having a nonlinearity constant that facilitates the generation of output acoustic power at the ink surface at a second level that is above the first power level.

5. An acoustic ink printing element having a power transfer function that includes a nonlinear region, the nonlinear region being onset at a first power level, the element comprising:

a piezoelectric transducer;

a glass substrate attached to the piezoelectric transducer;

a lens formed on the glass substrate, the lens having a focal length;

a liquid level of control plate having an aperture formed therein, the aperture having a diameter, and spaced from the substrate; and, ink disposed between the plate and the glass substrate having an ink surface exposed by the aperture, wherein the ratio of the focal length to the aperture diameter is such that generation of output acoustic power at the ink surface is at a second power level that is above the first power level.

6. An acoustic ink printing method for an acoustic ink printing element having a piezoelectric transducer attached to a glass substrate having formed thereon a lens, a liquid level control plate having an aperture formed therein and spaced from the substrate, an ink disposed between the plate and the glass substrate having an ink surface exposed by the aperture, the element having a power transfer function that includes a nonlinear region, the nonlinear region being onset at a first power level, a method comprising steps of:

supplying input power by generating a radio frequency signal;

applying the generated signal to the piezoelectric transducer;

propagating sound waves through the glass substrate based on the applying at a frequency that will generate output acoustic power of the ink surface at a second level that is above the first level;

focusing the sound waves by the lens;

propagating the focussed sound waves through the ink;

emitting a droplet of the ink from the ink surface through he aperture based on the focussed sound waves.

7. An acoustic ink printing method for an acoustic ink printing element having a piezoelectric transducer, attached to a glass substrate having formed thereon a lens, a liquid level control plate having an aperture formed therein and spaced from the substrate, and ink disposed between the plate and the glass substrate having an ink surface exposed by the aperture, the element having a power transfer function that includes a nonlinear region, the nonlinear region being onset at a first power level, the method comprising steps of:

supplying input power by generating a radio frequency signal;

applying the generated signal to the piezoelectric transducer;

propagating sound waves through the glass substrate based on the applying;

focusing the sound waves by the lens;

propagating the focussed sound waves through the ink;

maintaining the velocity of the focused sound waves in the ink such that generated output acoustic power at the ink surface will be at a second level that is above the first level; and, emitting a droplet of ink from the ink surface through the aperture based on the focused sound waves.

8. An acoustic ink printing method for an acoustic ink printing element having a piezoelectric transducer, attached to a glass substrate having formed thereon a lens, a liquid level control plate having an aperture formed therein and spaced from the substrate, and ink disposed between the plate and the glass substrate having an ink surface exposed by the aperture, the element having a power transfer function that includes a nonlinear region, the nonlinear region being onset at a first power level, the method comprising steps of:

supplying input power by generating a radio frequency signal that has a pulse width such that generated output acoustic power at the ink surface will be at a second level that is above the first level;

applying the generated signal to the piezoelectric transducer;

propagating sound waves through the glass substrate based on the applying;

focusing the sound waves by the lens;

propagating the focused sound waves through the ink; and, emitting a droplet of the ink from the ink surface through the aperture based on the focused sound waves.

9. An acoustic ink printing method for use in a system with an acoustic element comprising steps of:

supplying input acoustic power to the element; and, generating an output acoustic power that is above a power level corresponding to onset of nonlinearity as follows:

$$P_{onset} = \frac{0.1}{F^2 f^2} \rho \frac{c^5}{16\pi^3 \beta^2}$$

where ρ and c and β are density, sound velocity and nonlinearity constant of a liquid, respectively, F is a ratio of a focal length of a lens to an aperture diameter and f is frequency of sound waves.

10. An acoustic ink printing element in a system comprising:

means for supplying input acoustic power to the element; and, means for generating an output acoustic power that is above a power level corresponding to onset of nonlinearity in the system.

11. The acoustic ink printing element as set forth in claim 10 wherein the generating means comprises a lens having a focal length and an aperture having an aperture diameter such that the ratio of the focal length to the aperture diameter is such that generation of the output acoustic power is at an operating power level that is above the power level.

12. An acoustic ink printing method for use in a system with an acoustic element comprising steps of:

supplying input acoustic power to the element; and, generating an output acoustic power that is above a power level corresponding to onset of nonlinearity in the system.

* * * * *